US006962512B2

(12) United States Patent
Moret Codina

(10) Patent No.: US 6,962,512 B2
(45) Date of Patent: Nov. 8, 2005

(54) UNIT FOR CONNECTING CONDUCTORS TO TERMINALS

(76) Inventor: Maria Cristina Moret Codina, Ferran Agullo'No. 20 pral. 1ª, 08021 Barcelona (ES)

( * ) Notice: Subject to any disclaimer, the term of this patent is extended or adjusted under 35 U.S.C. 154(b) by 0 days.

(21) Appl. No.: 10/002,563

(22) Filed: Nov. 1, 2001

(65) Prior Publication Data

US 2002/0076972 A1 Jun. 20, 2002

(30) Foreign Application Priority Data

Nov. 3, 2000 (ES) ..... 200002682 U

(51) Int. Cl.[7] ..... H01R 4/48
(52) U.S. Cl. ..... 439/835; 439/441
(58) Field of Search ..... 439/438, 439, 439/441, 835, 834, 440

(56) References Cited

U.S. PATENT DOCUMENTS 2,713,668 A * 7/1955 Gibilisco ..... 439/438
3,152,851 A * 10/1964 McLaughlin ..... 439/441
4,759,726 A 7/1988 Naylor et al.
5,915,991 A * 6/1999 Roman ..... 439/441
6,146,187 A * 11/2000 Pallai ..... 439/441
6,146,217 A * 11/2000 Osada ..... 439/441
6,261,120 B1 * 7/2001 Beege et al. ..... 439/441

FOREIGN PATENT DOCUMENTS

DE 36 09 998 * 7/1987
DE 37 43 409 * 6/1989
EP 0 246 199 * 11/1987
JP 01-130480 * 5/1989

* cited by examiner

*Primary Examiner*—Tho D. Ta
*Assistant Examiner*—Felix O. Figueora
(74) *Attorney, Agent, or Firm*—Michael J. Striker

(57) ABSTRACT

A unit for quick connection of conductors to terminals has a body, at least two mechanical devices each formed and operative for a quick connection conductors to terminals, a body, at least two mechanical devices each formed and operative for a quick connection of one conductor to each terminal and for disconnection of the one conductor from each terminal, the mechanical devices being formed so that each of the mechanical devices provides a quick connection of one of the conductors to each of the terminal, and a disconnection of the one conductor from each terminal without impairing the other of the mechanical devices and thereby the other conductor.

4 Claims, 4 Drawing Sheets

UNIT FOR CONNECTING CONDUCTORS TO TERMINALS

BACKGROUND OF THE INVENTION

The present invention relates to a unit for connecting conductors to terminals.

More particularly, the present invention relates to a unit for terminals which constitute the central internal body of the electric devices known and currently used, such as switches, pushbuttons, mounting plates and the like, a unit which is designed to allow connecting the external conductors which have side access, quickly and with full effectiveness and guaranty.

One of the tasks which presently requires special care and therefore have repercussions on the times for mounting the installations, is connecting the terminals of conductors which has a repercussion on the electric device, and operation which requires, either an installation prior to the terminals, or an industrious hand folding or braiding around the setscrew itself on the terminal.

SUMMARY OF THE INVENTION

Accordingly, it is an object of present invention to provide a unit for quick connection to terminals which avoids the drawbacks of the prior art.

These drawbacks are overcome by using the unit for terminals which is provided with a mechanical device by means of which immediate fastening and setting is carried out and without any prior preparation of the clean end of the cable, a conductor which have to be located within the receptacle of the connecting terminal, the said cable having a side access with respect to the unit longitudinal plane of symmetry which is disclosed below.

This device will also allow to provide that in a single unit several devices of quick connection are arranged allowing for connecting two conductors, and it is provided that connecting or disconnecting one of the conductors will absolutely not affect the other, that is to say, that first one can be connected and thereafter the other without disconnecting the first is required, offering identical possibility in the reverse operation of disconnection.

In keeping with these objects and with others which will become apparent hereinafter, one feature of present invention resides, briefly stated in a body; at least two mechanical devices each formed and operative for a quick connection of one conductor to each terminal and for disconnection of said one conductor from each terminal, said mechanical devices being formed so that each of said mechanical devices provides a quick connection of one of the conductors to each of the terminal, and a disconnection of said one conductor from each terminal without impairing the other of the mechanical devices and thereby the other conductor.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
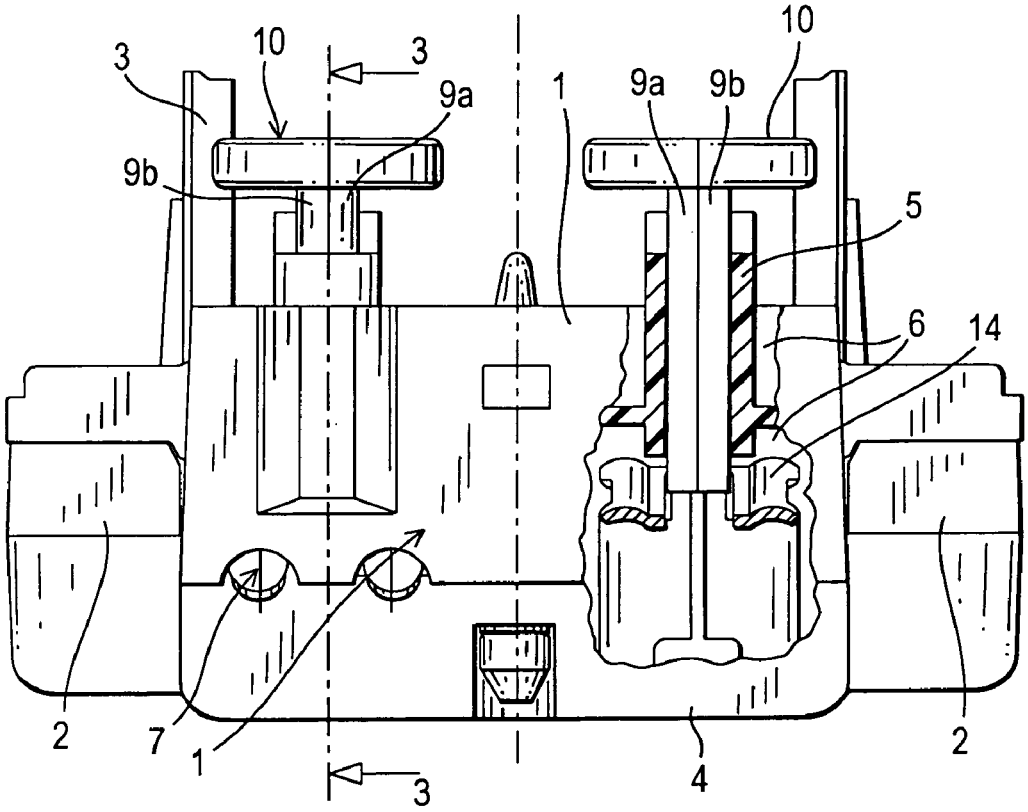
FIG. 1 is a front view of the unit, partly sectioned, in order to show the location of one of its elements of quick connection.

A unit of terminals with quick connection in accordance with the present invention has a prismatic body 1, hollow inside, provided with side ribs or flanges 2 for fastening it at the corresponding places of the electric device, not shown, as well as the top side ribs 3, also by fastening. All the lower part of the block is closed by the mounting plate 4.

The central part of the body has a series of walls which constitute, first, the housing 5 where the driving lever of the quick connection mechanism is located. These small walls are extending within the body 1, constituting the spaces 6 designed to the suitable location of the corresponding elements, not drawn, of the electric device to which the terminal unit will be jointed.

At the external part of the body 1 and at the corresponding area of the lower part of the housings 5 there are holes 7 which provide access by the sides the ends of the conductors 8 and 8*a* to be connected. These holes 7 also affect the coinciding top edge of the closing base plate 4.

Figure 2:
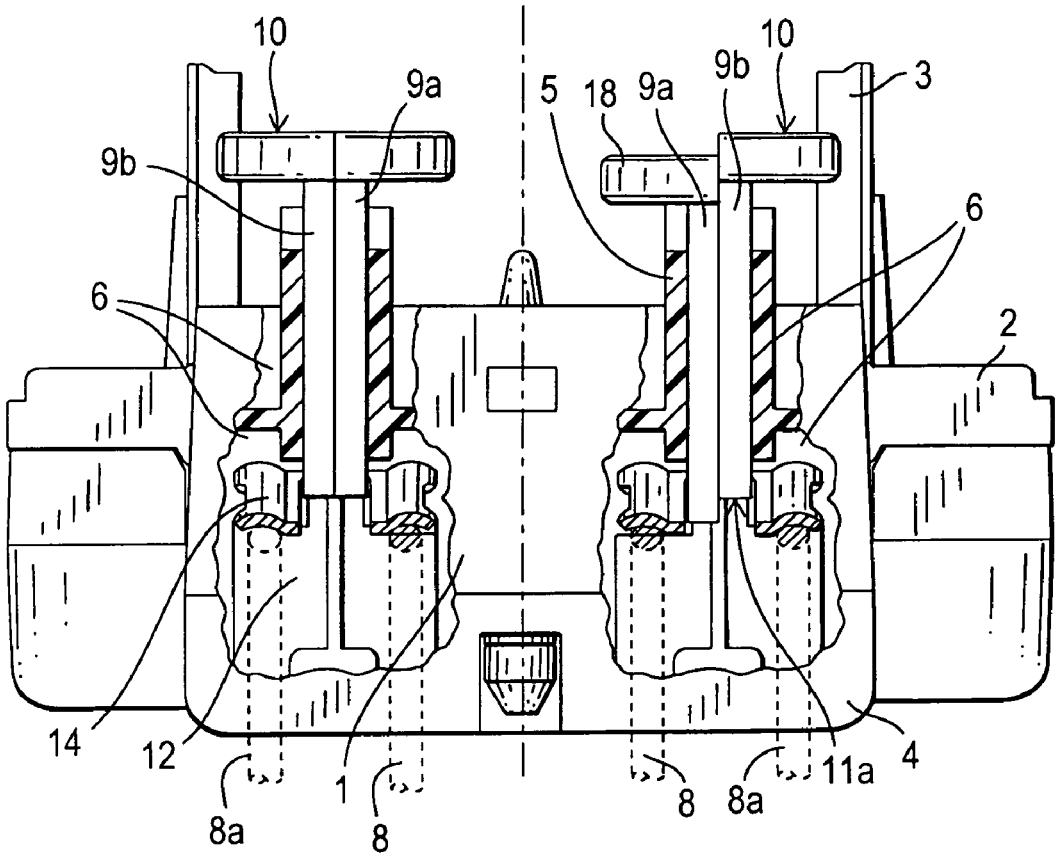
FIG. 2 is an also front view of the block, identical to that of the preceding figure, with two symmetrical areas partly sectioned, also showing the arrangement of the quick connecting elements and, namely, the different position of two contiguous driving levers.

The quick connection mechanism is constituted by a driving lever 9 generally formed by two identical and independent levers 9*a* and 9*b*, FIGS. 1 and 2 symmetric with respect to their plane of contact.

Figure 4:
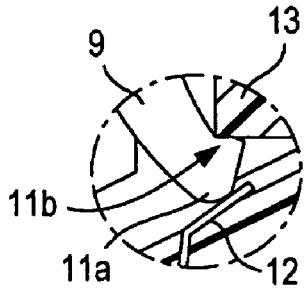
FIG. 4 is a detail at larger scale of the lower part of the driving lever of the mechanism.

Each lever possesses a flat top base 10 by which they can be driven, by pushing it down and which is ending at its lower part in a rounded shape 11*a*, together with a stop latch 11*b*. The rounded end 11*a* will remain supported on the respective elastic metal strip 12 which keeps the lever up with the stop latch 11*b* retained against the lower edge 13 of the housing small wall 5, as it is noted in the detail of FIG. 4.

Figure 3:
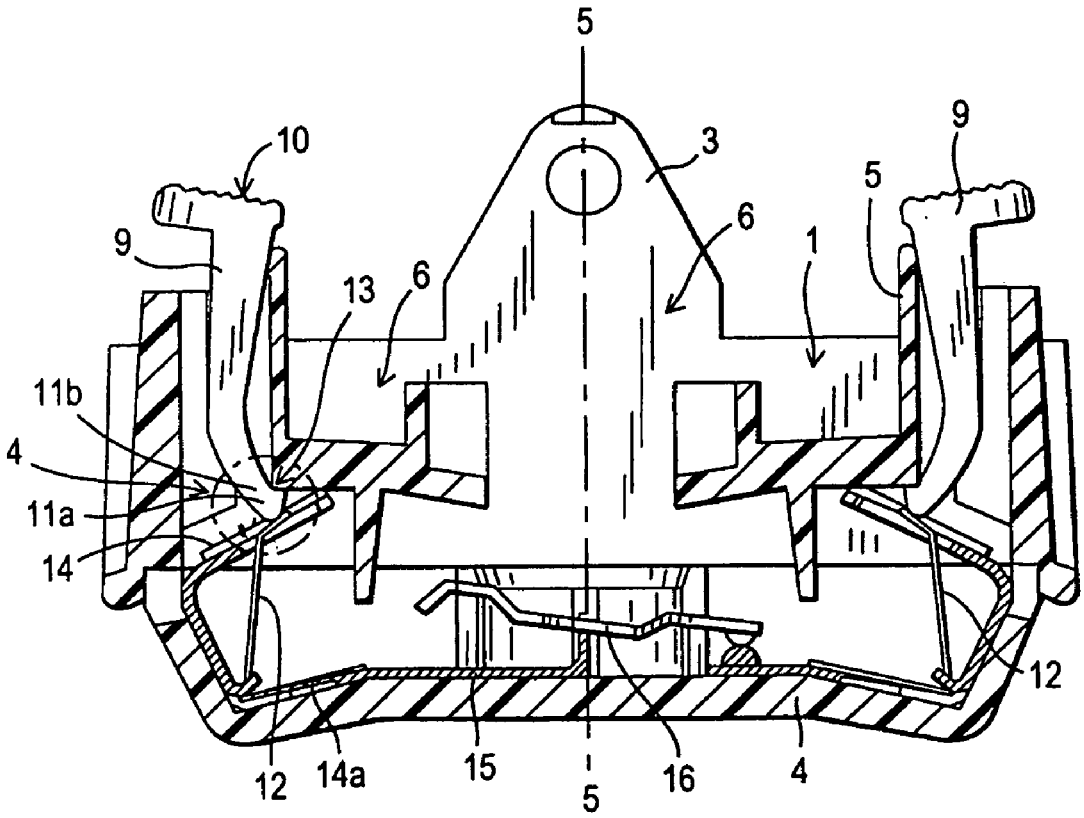
FIG. 3 is a side sectional view, through plane 3—3, of FIG. 1, showing the arrangement of the different mechanisms of connection, as well as the mounting plate on which the unit of terminals is installed.

The elastic metal strip 12 remains supported on the bottom of the plate 4, while its top end, divided into two symmetric and spaced parts goes between the contact bases 14 having a corrugated shape of a convex bar, located facing the holes of the side inlets 7 for the conductors to be connected 8 and 8*a*. These contact bases 14 are downwardly extended 14*a* ending on the bottom plate 4, keeping the connection through the metal element 15 located for that purpose, with the contacts the electric device 16 possesses, as illustrated in FIG. 3.

The quick connection mechanism is arranged so that each device having available symmetric levers 9*a* and 9*b* will allow the location and connection of two conductors 8 and 8*a*. Under the levers there are also located two divided top parts of the elastic metal strip 12 symmetrically and independently arranged, as well as the two contact bases 14 also symmetrically and independently arranged as it is shown in details in FIGS. 1 and 2. In the second figure, one of the two symmetric levers 9*a* is drawn located lower, a position that is swill adopt when conveniently pressed down.

Figure 5:
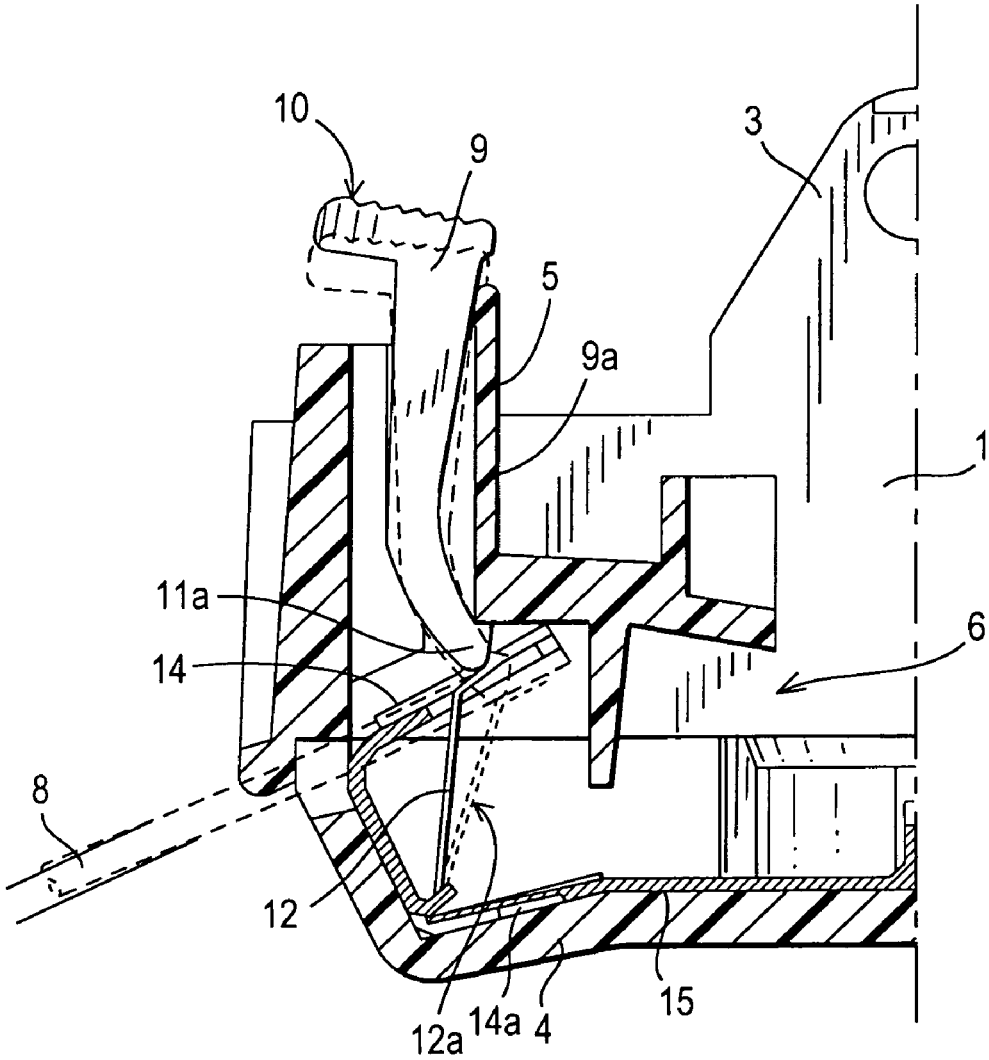
FIG. 5 is a part sectional view of the unit corresponding to FIG. 3, showing the end positions of the driving lever, together with the elastic metal strips with which the mechanism is provided, and the fastening of the cable in the connection area.

At the moment when the lever 9 is pressed down position 9*a*, it bends downwards corresponding elastic metal strip 12, which remains at the position 12*a* FIG. 5, under the contact base 14, which will allow that the end of the conductor 8 can be quite easily introduced through related side hole 7, being situated under the convex bar of the contact base 14. When the lever, at that moment, is no more pressed down, it leaves its position 9*a*, passing to the normal position 9 pushed by the elastic metal strip 12 which, in turn, strongly presses the conductor 8 against the contact base 14. The quick connection of the conductor 8 is thus carried out, with full guaranty, within the body 1, through the side access FIG. 5 clearly shows this action of the device of the invention.

As it has been stated before, this connection is carried out without absolutely impairing the positioning of the second conductor 8*a* previously connected, as well as disconnecting them when they are connected.

It is obvious that the invention does not require screws at any moment for the connection as it was usual up to now, which allows an independent action in each case.

Sufficiently disclosed the unit of terminals for quick connection, object of this utility model, it must be stated that any variation of sizes, shapes and external appearance, as well as any kind and quality of materials used for the embodiment of the said unit, will absolutely not impair the spirit thereof which is summarized in the following claims.

What is claimed is:

1. A unit for quick connecting and disconnecting of conductors, comprising a single body in which conductors are introducible; at least two mechanical devices accommodated in said single body and each formed and operative for a quick connection of at least one of two conductors and for disconnection of said at least one of two conductors, each of said mechanical devices being formed so that each of said mechanical devices provides a quick connection of one of two conductors in said single body, and a disconnection of said one conductor in said single body without impairing another conductor of the same mechanical device and without impairing the conductors in another mechanical device, so that each of four conductors can be connected or disconnected individually and separately from one another, each of said mechanical devices having two opposite sides which are spaced from one another in a predetermined direction, each of said mechanical devices on each of said sides having at least two holes which are spaced from one another in a first direction which is perpendicular to said predetermined direction so that at least two conductors are insertable into said at least two holes on each of said sides independently from one another to be spaced from one another in said first direction, each of said mechanical devices including an operating lever having two identical and independent levers symmetrically located with respect to a contact plane and spaced from each other in said first direction, each lever being provided with a top flat base for operation and ending in a rounded lower end, a stop latch provided at said rounded lower end and preventing an unwanted exit of said lever from a place where said lever is located, a resilient metal strip situated under said lever and keeping said lever raised, two contacting bases which are formed also symmetrically and independently, said resilient metal strip having a top end divided into two symmetrical and spaced parts including one part for each lever such that said parts of said resilient metal strip are spaced from each other in said first direction, said ends being formed so as to pass under ends of the conductors to be connected, so that when one of said identical and independent levers of said operating lever is pressed down it bends downwards a corresponding one of said symmetrical and spaced parts of said resilient metal strip which remains at a position under a respective one of said contact bases which will allow that an end of the conductor can be easily introduced through a respective one of said holes being situated under said contact base, while when said one identical and independent lever of said operating lever is no more pressed down it leaves said position passing to a normal position pushed by said one symmetrical and spaced part of said resilient metal strip which in turn presses the conductor against said contact base.

2. A unit as defined in claim 1; and further comprising a bottom, said metal strip being supported on said bottom.

3. A unit as defined in claim 1; and further comprising a bottom plate, wherein said contacting bases which are formed also symmetrically and independently end on said bottom plate with interposition of a metal element, said elastic metal strip with said divided top parts extending between said bases.

4. A unit for quick connecting and disconnecting conductors to terminals, comprising a single body in which conductors are introducible; at least two mechanical devices accommodated in said single body and each formed and operative for a quick connection of at least one of two conductors and for disconnection of said at least one of two conductors, each of said mechanical devices being formed so that each of said mechanical devices provides a quick connection of one of the two conductors in said single body, and a disconnection of said one conductor in said single body without impairing another conductor of the same mechanical device and without impairing the conductors in another mechanical device, so that each of four conductors can be connected or disconnected individually and separately from one another, each of said mechanical devices having two opposite sides which are spaced from one another in a predetermined direction, each of said mechanical devices on each of said sides having at least two holes which are spaced from one another in a first direction which is perpendicular to said predetermined direction so that at least two conductors are insertable into said at least two holes on each of said sides independently from one another to be spaced from one another in said first direction, each of said mechanical devices including an operating lever having two identical independent levers symmetrically located with respect to a contact plane and spaced from each other in said first direction, each lever being provided with a top flat base for operation and ending in a rounded lower end, a stop latch provided at said rounded lower end and preventing an unwanted exit of said lever from a place where said lever is located, a resilient metal strip situated under said lever and keeping said lever raised, two contacting bases which are formed also symmetrically and independently, said resilient metal strip having a top end divided into two symmetrical and spaced parts including one part for each lever such that said parts of said resilient metal strip are spaced from each other in said first direction, said ends being formed so as to pass under ends of the conductors to be connected, so that when one of said identical and independent levers of said operating lever is pressed down it bends downwards a corresponding one of said symmetrical and spaced parts of said resilient metal strip which remains at a position under a respective one of said contact bases which will allow that an end of the conductor can be easily introduced through a respective one of said holes being situated under said contact base, while when said one identical and independent lever of said operating lever is no more pressed down it leaves said position passing to a normal position pushed by said one symmetrical and spaced part of said resilient metal strip which in turn presses the conductor against said contact base, side holes arranged so that the conductors to be connected are introducible from outside through said holes, said levers being arranged so that when a corresponding one of said levers is pushed said corresponding lever goes down against an action of said resilient metal strip, which goes down against an action of said resilient metal strip, which goes down alloying an easy and immediate introduction of an end of the conductor to be connected through said side hole and when said lever is no longer pressed down said lever is going back to an initial position under the action of said elastic metal strip which in turn presses and locks the conductor to connect said conductor.

* * * * *